US011741926B2

(12) United States Patent
Rangarajan et al.

(10) Patent No.: US 11,741,926 B2
(45) Date of Patent: Aug. 29, 2023

(54) ECHO CANCELATION

(71) Applicant: Ford Global Technologies, LLC, Dearborn, MI (US)

(72) Inventors: Ranjani Rangarajan, Farmington Hills, MI (US); Leah N. Busch, Berkley, MI (US); David Graham Smith, Dearborn, MI (US); Jake Schwartz, Dearborn, MI (US); Thomas Chrapkiewicz, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/347,656

(22) Filed: Jun. 15, 2021

(65) Prior Publication Data

US 2022/0406284 A1 Dec. 22, 2022

(51) Int. Cl.
*G10K 11/00* (2006.01)
*G10K 11/175* (2006.01)

(52) U.S. Cl.
CPC ..... *G10K 11/002* (2013.01); *G10K 11/1752* (2020.05); *G10K 2210/505* (2013.01)

(58) Field of Classification Search
CPC ..... G10K 11/002; G10K 11/1752; G10K 2210/505
USPC ..... 381/71.4
See application file for complete search history.

(56) References Cited

U.S. PATENT DOCUMENTS

| | | | | |
|---|---|---|---|---|
| 5,909,384 | A * | 6/1999 | Tai | G06F 17/10 370/290 |
| 6,236,725 | B1 | 5/2001 | Takada et al. | |
| 6,487,529 | B1 | 11/2002 | Miet | |
| 10,389,861 | B2 | 8/2019 | Mani et al. | |
| 2008/0273715 | A1 * | 11/2008 | Snider | B60R 11/0217 381/86 |

OTHER PUBLICATIONS

Maebashi et al., "Influence of the tap length of an adaptive filter for the acoustic echo canceller on perception", Acoust. Sci. & Tech., 23, 5 (2002).

* cited by examiner

*Primary Examiner* — Vivian C Chin
*Assistant Examiner* — Douglas J Suthers
(74) *Attorney, Agent, or Firm* — Brandon Hicks; Bejin Bieneman PLC

(57) ABSTRACT

A system for dynamically controlling an echo canceler includes a processor programmed to receive audio data from an audio sensor, to determine a present type of noise in the received audio data, based on the present type of noise, to determine a number of taps to be removed from an echo canceler, and to execute the echo canceler with a reduced number of taps based on the number of taps to be removed.

12 Claims, 5 Drawing Sheets

ECHO CANCELATION

BACKGROUND

Vehicle interiors may be designed to provide a quiet environment for occupant comfort, to improve perception of audio, etc. As a result, a sound originating from the exterior of the vehicle may not be heard by a vehicle occupant, or may be incorrectly or incompletely perceived. For example, if someone outside of a vehicle is speaking, someone in the vehicle interior may not know that the person is speaking or may not be able to understand what the person is saying.

DETAILED DESCRIPTION

Figure 1:
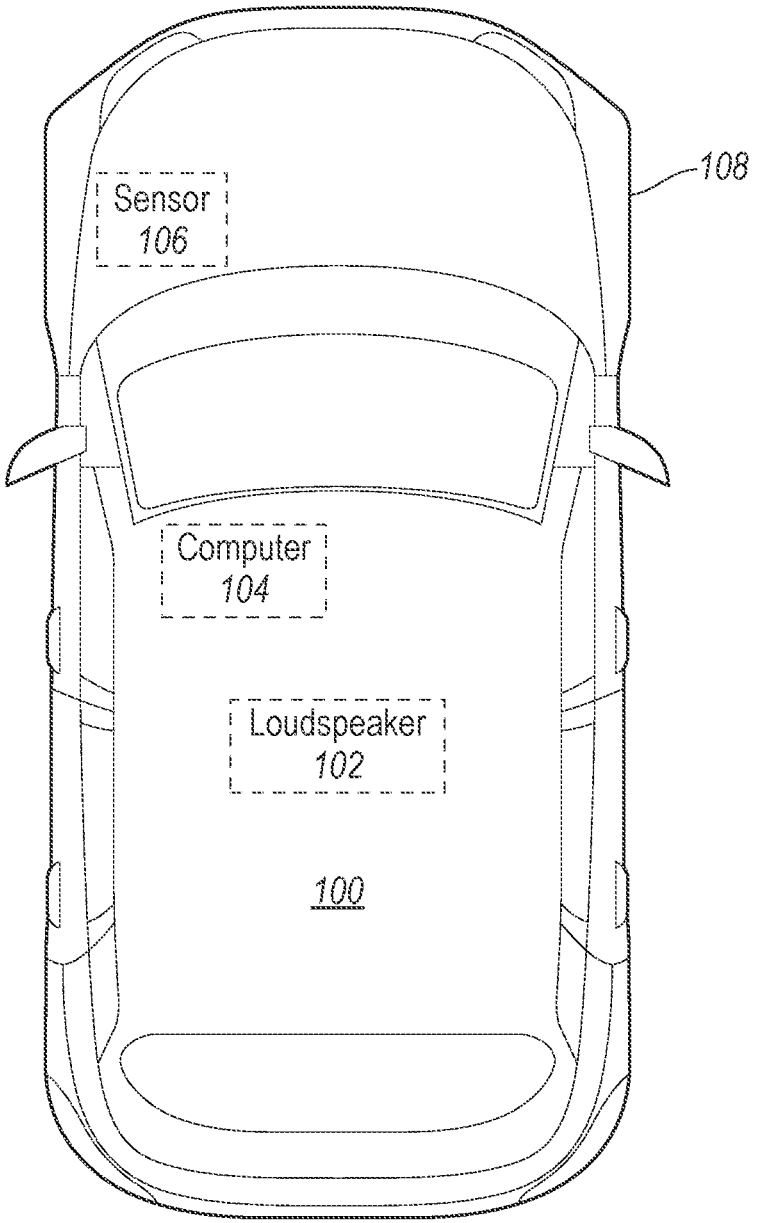
FIG. 1 shows a block diagram of an example vehicle.

Referring to FIG. 1, an exterior surface of a vehicle 100 may be used as a microphone to capture sounds from outside the vehicle 100, while an interior loudspeaker 102 outputs sounds received from the vehicle 100 exterior, thereby providing information from the vehicle 100 exterior environment to vehicle 100 occupants.

A vehicle 100 may include one or more devices for capturing sounds outside of the vehicle 100, e.g., a speech of a person outside a vehicle 100, sounds of leaves rustling while driving through a natural park, etc., for interior playback. A structural and acoustic coupling between an exterior surface audio sensor 106, e.g., a microphone, and interior loudspeakers 102 can result in echoes that in turn cause a poor listening experience for vehicle 100 occupants. A vehicle 100 may include an echo cancelation system, e.g., a computer 104 programmed to execute an echo cancelation program. However, echo cancelation typically consumes a considerable amount of processing power and computing resources that could otherwise be allocated to other operations in a vehicle 100 computer 104. Advantageously, disclosed herein are techniques for suppressing an echo while reducing computer 104 resources needed for echo cancelation. A noise masking effect (i.e., noise masking the present echo) can be advantageously utilized with dynamic control of an echo canceler to cancel fewer echoes in the presence of noise, thereby conserving resources (i.e., computation power and/or memory) that are then available for other uses in the vehicle 100.

FIG. 1 illustrates an example host vehicle 100 including a computer 104, sensor(s) 106, and actuator(s). A vehicle 100 may be any suitable type of ground vehicle 100, e.g., a passenger or commercial automobile such as a sedan, a coupe, a truck, a sport utility, a crossover, a van, a minivan, a taxi, a bus, etc. The vehicle 100 may include a vehicle body 108. The vehicle body 108 includes body panels partially defining an exterior of the vehicle 100. The body panels may present a class-A surface, e.g., a finished surface exposed to view by a customer and free of unaesthetic blemishes and defects. The body panels include, e.g., a roof, side panels, etc.

The vehicle 100 computer 104 includes a processor and a memory such as are known. The memory includes one or more forms of computer 104 readable media, and stores instructions executable by the vehicle 100 computer 104 for performing various operations, including as disclosed herein. For example, the computer 104 can be a generic computer 104 with a processor and memory as described above and/or may include an electronic control unit (ECU) or controller for a specific function or set of functions, and/or a dedicated electronic circuit including an ASIC that is manufactured for a particular operation, e.g., an ASIC for processing sensor data and/or communicating the sensor data. In another example, computer 104 may include an FPGA (Field-Programmable Gate Array) which is an integrated circuit manufactured to be configurable by a user. Typically, a hardware description language such as VHDL (Very High-Speed Integrated Circuit Hardware Description Language) is used in electronic design automation to describe digital and mixed-signal systems such as FPGA and ASIC. For example, an ASIC is manufactured based on VHDL programming provided pre-manufacturing, whereas logical components inside an FPGA may be configured based on VHDL programming, e.g. stored in a memory electrically connected to the FPGA circuit. In some examples, a combination of processor(s), ASIC(s), and/or FPGA circuits may be included in a computer 104.

The memory can be of any type, e.g., hard disk drives, solid state drives, servers, or any volatile or non-volatile media. The memory can store the collected data sent from the sensors 106. The memory can be a separate device from the computer 104, and the computer 104 can retrieve information stored by the memory via a network in the vehicle 100, e.g., over a CAN bus, a wireless network, etc. Alternatively or additionally, the memory can be part of the computer 104, e.g., as a memory of the computer 104.

The computer 104 may include programming to operate one or more of vehicle 100 brakes, propulsion (e.g., control of acceleration in the vehicle 100 by controlling one or more of an internal combustion engine, electric motor, hybrid engine, etc.), steering, climate control, interior and/or exterior lights, etc., as well as to determine whether and when the computer 104, as opposed to a human operator, is to control such operations. Additionally, the computer 104 may be programmed to determine whether and when a human operator is to control such operations. The computer 104 may include or be communicatively coupled to, e.g., via a vehicle 100 network such as a communications bus as described further below, more than one processor, e.g., included in components such as sensors 106, electronic controller units (ECUs) or the like included in the vehicle 100 for monitoring and/or controlling various vehicle 100 components, e.g., a powertrain controller, a brake controller, a steering controller, etc. The computer 104 is generally arranged for communications on a vehicle 100 communication network that can include a bus in the vehicle 100 such as a controller area network (CAN) or the like, and/or other wired and/or wireless mechanisms. Alternatively or additionally, in cases where the computer 104 actually comprises a plurality of devices, the vehicle 100 communication network may be used for communications between devices represented as the computer 104 in this disclosure. Further, as mentioned below, various controllers and/or sensors 106 may provide data to the computer 104 via the vehicle 100 communication network.

Actuators in a vehicle 100 are typically implemented via circuits, chips, or other electronic and/or mechanical components that can actuate various vehicle 100 subsystems in accordance with appropriate control signals, as is known. The actuators may be used to control vehicle 100 systems such as braking, acceleration, and/or steering of the vehicles 100.

A speaker, or loudspeaker 102, is a device that, as is well known, can convert an electrical signal to sound, i.e., a loudspeaker 102 can include a transducer that converts the electric signal to vibrations to generate sound at a desired frequency. A loudspeaker 102 can receive the electrical signal from an audio amplifier.

An audio amplifier, as is known, can amplify an electric signal provided to drive a loudspeaker 102. An amplifier can be used to control amplitude of a signal, e.g., volume of a sound (e.g., in decibels) of a sound to be output by a loudspeaker 102.

Vehicles 100, such as autonomous or semi-autonomous vehicles 100, typically include a variety of sensors 106. A sensor 106 is a device that can obtain one or more measurements of one or more physical phenomena. Some sensors 106 detect internal states of the vehicle 100, for example, wheel speed, wheel orientation, and engine and transmission variables. Some sensors 106 detect the position or orientation of the vehicle 100, for example, global positioning system (GPS) sensors 106; accelerometers such as piezoelectric or microelectromechanical systems (MEMS); gyroscopes such as rate, ring laser, or fiber-optic gyroscopes; inertial measurements units (IMU); and magnetometers. Some sensors 106 detect the external world, for example, radar sensors 106, scanning laser range finders, light detection and ranging (LIDAR) devices, and image processing sensors 106 such as cameras. A LIDAR device detects distances to objects by emitting laser pulses and measuring the time of flight for the pulse to travel to the object and back. Some sensors 106 are communications devices, for example, vehicle 100-to-infrastructure (V2I) or vehicle 100-to-vehicle 100 (V2V) devices. Sensor operation can be affected by obstructions, e.g., dust, snow, insects, etc. Often, but not necessarily, a sensor includes a digital-to-analog converter to converted sensed analog data to a digital signal that can be provided to a digital computer 104, e.g., via a network. Sensors 106 can include a variety of devices, and can be disposed to sense and environment, provide data about a machine, etc., in a variety of ways. For example, a sensor could be mounted to a stationary infrastructure element on, over, or near a road. Moreover, various controllers in a vehicle 100 may operate as sensors 106 to provide data via the vehicle 100 network or bus, e.g., data relating to vehicle 100 speed, acceleration, location, subsystem and/or component status, etc. Further, other sensors 106, in or on a vehicle 100, stationary infrastructure element, etc., infrastructure could include cameras, short range radar, long range radar, LIDAR, and/or ultrasonic transducers, weight sensors 106, accelerometers, motion detectors, etc., i.e., sensors 106 to provide a variety of data. To provide just a few non-limiting examples, sensor data could include data for determining a position of a component, a location of an object, a speed of an object, a type of an object, a slope of a roadway, a temperature, a presence or amount of moisture, a fuel level, a data rate, etc.

The vehicle 100 can include an HMI (human-machine interface), e.g., one or more of a display, a touchscreen display, a microphone, a loudspeaker 102, etc. The user can provide input to devices such as the computer 104 via the HMI. The HMI can communicate with the computer 104 via the vehicle 100 network, e.g., the HMI can send a message including the user input provided via a touchscreen, microphone, a camera that captures a gesture, etc., to a computer 104, and/or can display output, e.g., via a screen, loudspeaker 102, etc.

As discussed above, e.g., to provide information from the vehicle 100 exterior environment to vehicle 100 occupants, a vehicle 100 may be configured, e.g., by programming a vehicle 100 computer 104, to transfer audio data, e.g., sound of a person talking, etc., from outside of the vehicle 100 to a vehicle 100 interior. The computer 104 may be programmed to receive audio data from an audio senor, e.g., a microphone mounted to an exterior of the vehicle 100. Additionally or alternatively, the audio sensor may be any type of sensor that converts vibrations of the vehicle body 108 to an electronic signal, e.g., an electrical amplitude, a digital signal, etc. The computer 104 may be programmed to receive audio data via a vehicle 100 communication network, e.g., CAN bus, and/or any other type of wired or wireless communication.

The computer 104 may be programmed to output the received audio data to a vehicle 100 speaker that outputs sound to the vehicle 100 interior. Additionally or alternatively, the vehicle 100 may include electronics, e.g., filter circuit, amplifier circuit, configured to receive an audio signal from the audio sensor 106, and output filtered and/or amplified audio signal received from the audio sensor 106 to the vehicle 100 interior speaker.

There typically exists an acoustic coupling through the vehicle body 108 between the exterior surface and interior loudspeakers. Acoustic coupling means that sound is transmitted across an acoustic barrier and is measured by a degree to which sound is transmitted across the acoustic barrier. This acoustic coupling means that output of the interior loudspeaker 102 can typically be detected by the exterior audio sensor 106, which in turn produces an echo in the vehicle 100 interior. Because an echo is undesirable for vehicle 100 occupant(s), the vehicle 100 may include hardware and/or a software program stored in a vehicle 100 computer 104 to eliminate or reduce the echo using echo cancelation techniques.

An electronic circuit, e.g., including a firmware, filter circuit, amplifier circuit, etc., configured to reduce or eliminate an echo or a computer 104 programmed to reduce or eliminate an echo is referred to as an echo canceler. An echo canceler is typically a weighted filter that models an acoustic channel. An acoustic channel is a combination of equipment and physical media that can be used to propagate acoustic data and that has an associated frequency response. The frequency response of an acoustic channel affects sounds propagated through the channel. An adaptive filter may attempt to mimic the frequency response of the acoustic channel Once the acoustic model is created, the effect of the acoustic channel as well as an echo can be removed. An echo canceler dynamically calculates the weights of the taps L that model the acoustic channel Algorithms such as RLS (Recursive Least Squares), LMS (Least Mean Square), Kalman, NLMS (Normalized Least Mean Squares), etc. are used for the weight calculation. A filter tap corresponds to a weight associated with a delay sample in a digital filter. A tap can be associated with a feedback or feedforward signal. The number of taps, their values and whether they act as in either the feedback or feedforward orientation, determine a filter's frequency response.

Figure 2:
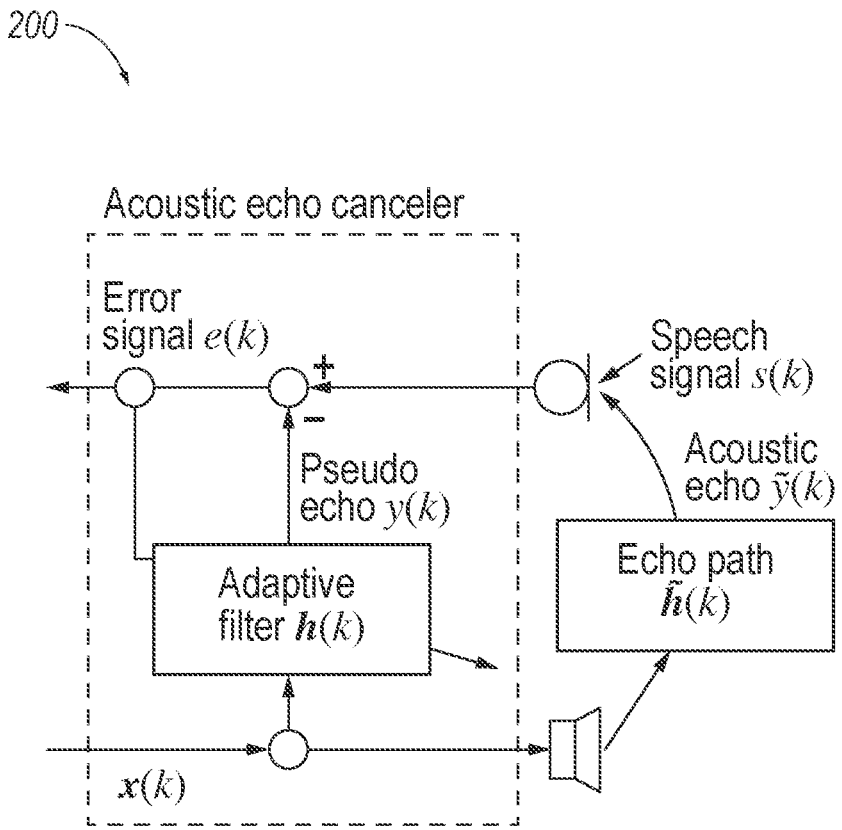
FIG. 2 shows a block diagram of an example echo canceler operation.

FIG. 2 shows a block diagram 200 of an exemplary echo canceler. With reference to Equations (1)-(2), an FIR (Finite Impulse Response) type digital filter with number of taps L may be used as an adaptive filter. The acoustic echo canceler may calculate a pseudo echo, y(k), which is similar to the existing acoustic echo, y'(k), by convoluting input signal x(k) and the adaptive filter coefficients h(k). T represents a transposing operation. To eliminate the acoustic echo, an error signal e(k) is obtained by subtracting y(k) from y'(k). Equation (3) shows an adaptive algorithm known as NLMS (Normalized Least Mean Square) where the constants ALPHA and BETA are parameters for adjustment conversion.

$$x(k) = [(x(k), x(k-1), x(k-2), \ldots, x(k-L+1)]^T \quad (1)$$

$$h(k) = [h_1(k), h_2(k), h_3(k), \ldots, h_L(k)]^T \quad (2)$$

$$\tilde{h}(k+1) = \tilde{h}(k) + \frac{\alpha}{x(k)^T x(k) + \beta} e(k)x(k) \quad (3)$$

With reference to Equation (1), a dimensionality of adaptive filter coefficients of an echo canceler h(k) increases, e.g., changing from a third-degree polynomial to a fourth-degree polynomial, as the number of taps increases. The computer 104 110 may be programmed to implement the echo canceler. Thus, if a number of taps L decreases, then a complexity (or a degree of the equation) of the adaptive filter h(k) decreases, which may reduce computer 104 resources such as processing time and/or memory consumed by the echo canceler. The number of taps L typically affects an amount of memory required to implement the echo canceler, and/or a number of calculations required in the echo canceler. Thus, an increasing number of taps L means more stopband attenuation, less ripple, etc.

Figure 3:
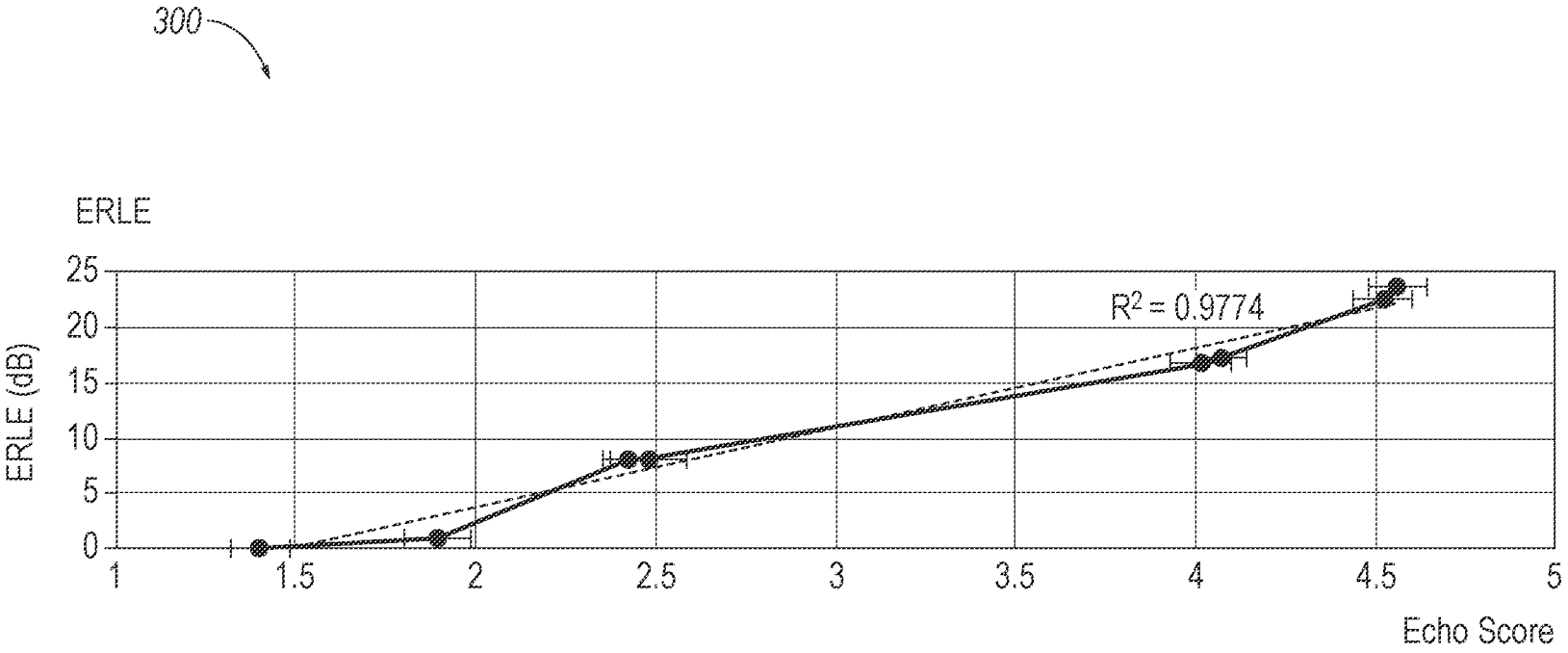
FIG. 3 is an exemplary graph of ERLE (Echo Return Loss Enhancement) versus echo score.
Figure 4:
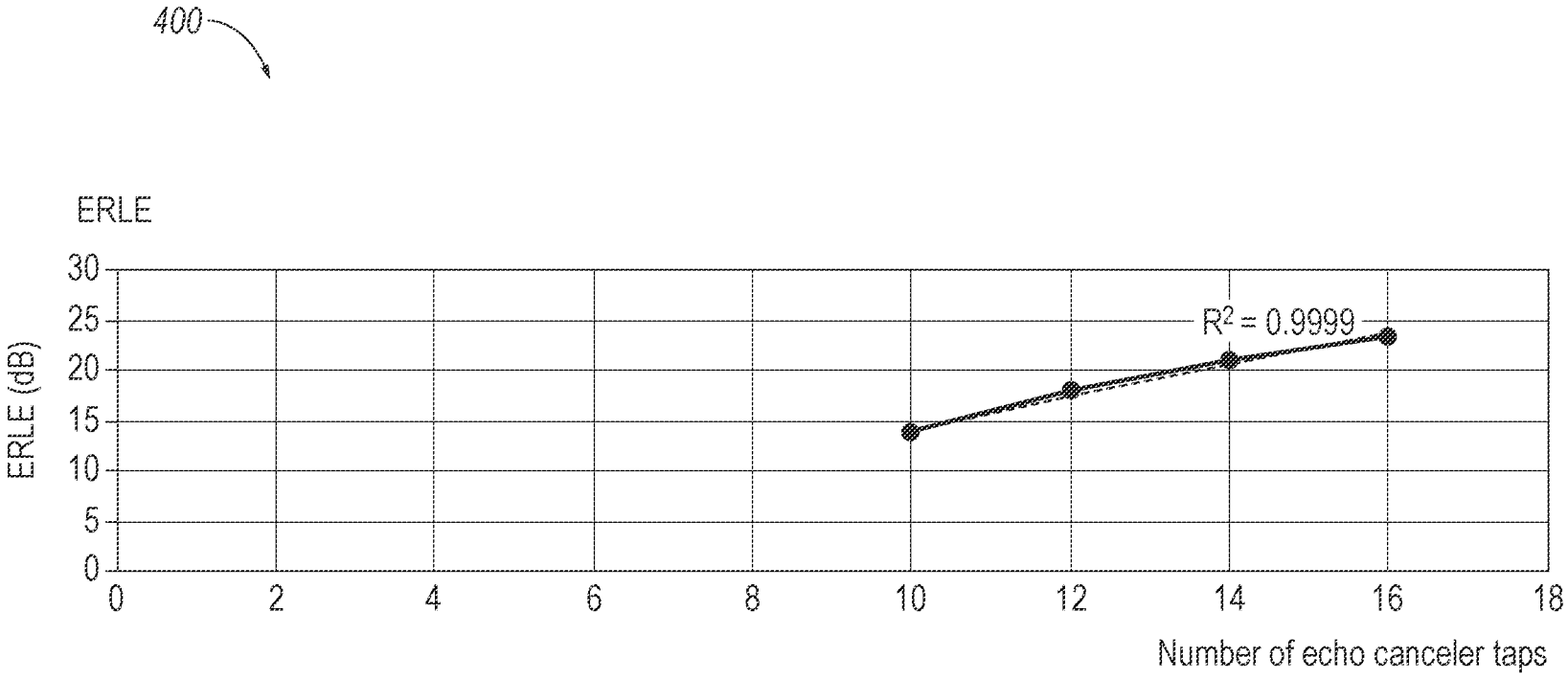
FIG. 4 is an exemplary graph of ERLE versus number of echo canceler taps.

FIG. 3 is a graph 300 showing an example relationship of an echo rating score with an echo canceler performance metric called ERLE (Echo Return Loss Enhancement). In one example, the computer 104 may be programmed to store data specifying a relationship of the echo rating score with an echo canceler ERLE metric. Such data may be determined using empirical techniques. As shown in FIG. 3, a 1 (one) point change in score is equivalent to an approximately 6 dB (decibel) change in ERLE. In the present context, an "echo rating score" measures a degree of discomfort for an occupant of the vehicle 100 caused by an echo. In one example, the echo rating scale may be specified in a range of 1 to 5, as shown in Table 1, i.e. the higher the subjective echo score, the lesser the echo is perceived. In other words, the higher the score, the higher is a comfort level (not being disturbed by echo) of a vehicle 100 occupant. With reference to FIGS. 3 and 4, a parameter $R^2$ is a coefficient representing a statistical measure of how close a line connecting data points (represented by the solid line in FIGS. 3 and 4) is to a fitted regression line (dashed line in FIGS. 3 and 4). In the context of present document, the computer 104 may store the data points and/or the fitted line in a computer 104 memory.

TABLE 1

| Echo scale | Definition |
|---|---|
| 1 | Intrusive |
| 2 | Somewhat intrusive |
| 3 | Noticeable but not intrusive |
| 4 | Somewhat noticeable |
| 5 | Not noticeable |

To study a perception of a vehicle 100 occupant about noise and echo, several empirical tests were performed. In a first test, road noise was absent while an echo was present. In a second test, road noise was present while the same echo as of the first test was present. Based on these tests, it was concluded that an occupant's echo rating score increased by 0.5 point (i.e., more comfortable) upon the presence of the road noise. This means that an occupant may perceive less echo in the presence of road noise. In other words, the echo canceler can be reduced in strength to compensate for this increase of 0.5 points in subjective echo scores, and the performance of an echo canceler, based on occupant perception, will be the same as it would when no noise is present. The computer 104 may store data specifying an increase of an echo score (i.e., echoes become less bothersome) based on different types of noise, e.g., an urban area noise, a suburban area noise, etc. For example, the computer 104 may store data specifying an improvement of rating score based on different types of noise, e.g., 0.5 increase of score for urban noise, 0.4 increase of score for suburban noise, etc.

As discussed above with reference to Table 1, it was determined that in presence of noise, the echo score improves (i.e., increases) by approximately 0.5 score points. This improvement of echo score in presence of noise typically depends on a type of noise and echo canceler used.

FIG. 4 is a graph showing a relationship of the ERLE metric of an echo canceler and the number of taps L of the echo canceler. The graph shows that reducing two taps L of the echo canceler is equivalent to approximately reducing 6 dB of echo canceler ERLE, e.g., a change from 10 taps to 14 taps approximately results in a change of ERLE from 14 to 20 db. In an example, the computer 104 may be programmed to store data specifying a relationship of the ERLE metric of the echo canceler and the number of taps L of the echo canceler. In an example, the computer 104 may be programmed to determine data specifying the relationship of the ERLE metric of the echo canceler and the number of taps L, e.g., by varying the number of taps L and determining a corresponding ERLE metric. As discussed with reference to example graph 300 shown in FIG. 3, a change of 6 dB in ERLE metric corresponds to a change of 1 (one) point in echo score. Thus, with reference to FIGS. 3 and 4, reducing 2 taps L of the echo canceler is approximately equivalent to a 0.5 drop of an echo score. In one example, a sub-band echo canceler includes 256 sub-bands. In this example, 1 (one) tap L is equivalent to about 256 coefficients used for implementing the echo canceler, e.g., coefficients of a function specifying the characteristics of the echo canceler FIR. Thus, reducing 2 taps L may then result in eliminating 512 coefficients of the echo canceler function, which is a significant saving in processing power.

The graphs of FIGS. 3-4 are referred to as adaptation curves. The graphs 300, 400, may be determined using empirical techniques. The computer 104 may store data specifying the curves of graphs 300, 400.

Less or more echo cancellation may be achieved by varying the number of taps L of an echo canceler. An echo canceler with fewer taps will provide less cancellation but will also use less processing power, and vice versa. With reference to FIG. 1, a vehicle 100 computer 104 can be programmed to receive audio data from one or more audio sensors 106, e.g., a microphone, to detect a present type of noise in the received signal, based on the type of noise, to determine a number of taps L to be reduced for an echo canceler (e.g., reducing a number of taps L to an updated number of taps L-2); and apply the determined number of taps to be reduced to the echo canceler.

The computer 104 may be programmed to actuate an echo canceler to cancel an echo between the audio sensor 106 and the loudspeaker 102 based on the determined number of taps to be reduced. In one example, the echo canceler includes electronics configured to apply echo cancelation based on configuration data such as number of taps L received from the computer 104. Thus, the computer 104 may be programmed to send data including a number of taps L to the echo canceler.

Upon instructing an echo canceler that has L taps to reduce a number of taps, e.g., decrease by 2 taps, the echo canceler will recalculate the weights that correspond to the L-2 taps such that the acoustic channel is modelled as accurately as possible. This re-calculation (which sometimes referred to as adaptation) can be performed in a conventional manner, e.g., by various algorithms such as RLS, LMS, Kalman, NLMS, etc.

The computer 104 may be programmed to determine a score based on the detected type of noise, and to determine the number of taps to be removed based on the determined score.

A type of noise may include an urban noise or a suburban noise present at a location of the vehicle 100. The computer 104 may be programmed to determine the present type of noise based on data stored in the memory specifying one or more noise characteristics of respective types of noise. For example, the computer 104 may store data specifying a frequency domain and/or other characteristics of respective noise types and identify a present type of noise based on the received audio data and stored data. The computer 104 may be programmed to determine a frequency spectrum of the received audio data and identify noise components in the frequency spectrum. The computer 104 may be programmed to then identify the present type of noise based on the identified noise components. For example, urban road noise has typically low-frequency components between 700-1300 Hz and very few other higher frequency components.

As discussed with reference to FIGS. 3-4, the computer 104 may be programmed to an adjustment of number of taps L based on a present type of noise and the adaptation curve. The computer 104 may be programmed based on an adaptation curve and the determined type of noise, to select a number of taps L by which an echo cancelation function is to be reduced.

A present type of noise received in the vehicle 100 interior may change, e.g., based on a change of location of the vehicle 100. Thus, the adjustment of the number of taps L may be dynamic, i.e., performed in real-time or near real-time based on detected noise. In one example, the computer 104 may be programmed to periodically determine a present type of noise and update the number of taps L based on the determined type of noise. The vehicle 100 computer 104 may determine a first score improvement upon determining an urban noise type, and determine a first number of taps L based on the first score, then the computer 104 may determine a second score improvement upon determining a suburban noise type, e.g., as the vehicle 100 exits an urban area and enters a suburban area, and determine a second number of taps L based on the second score.

Figure 5:
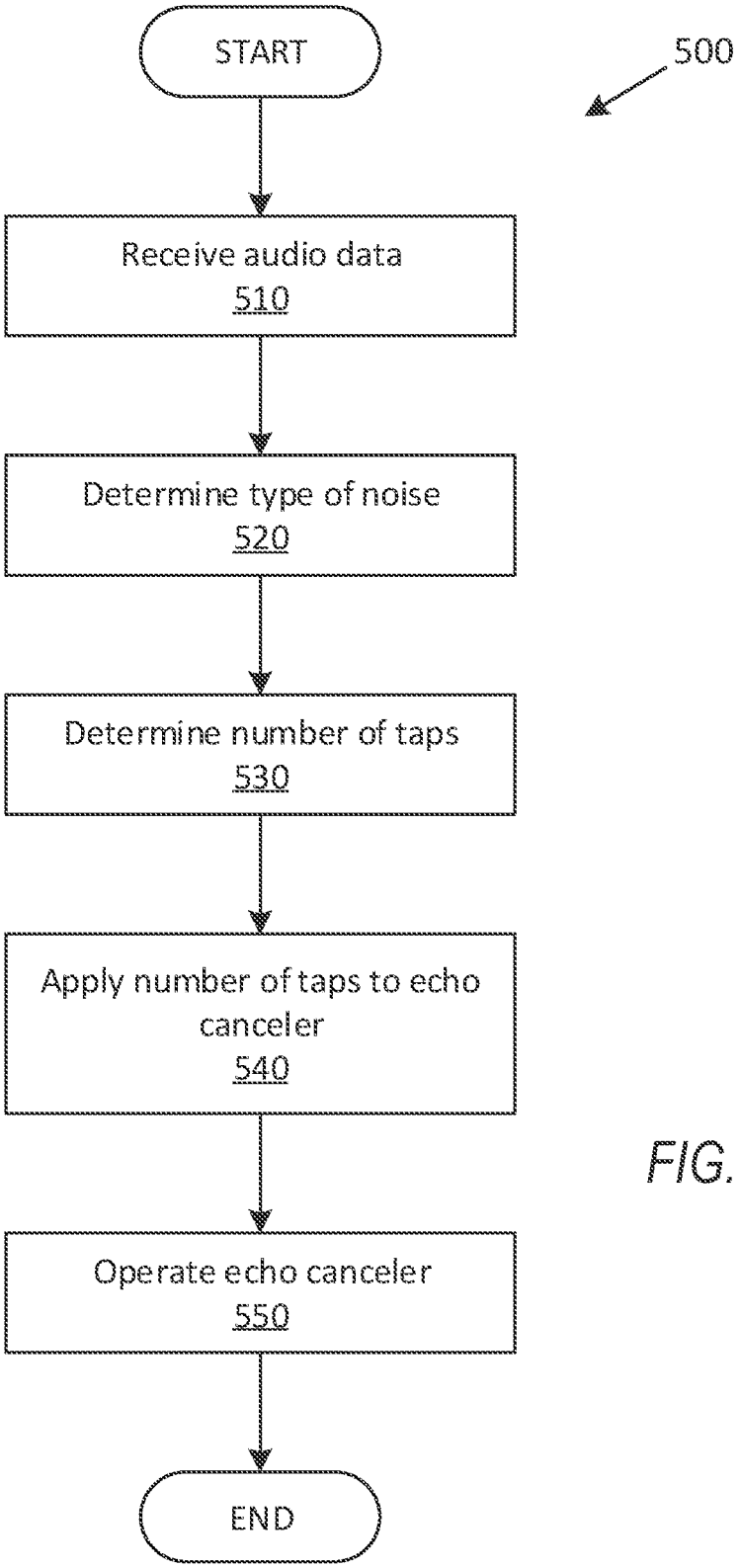
FIG. 5 is an example flowchart of a process for operating the echo canceler of the vehicle.

FIG. 5 is a flowchart of a process for operating an echo canceler of a vehicle 100. The computer 104 may be programmed to execute blocks of the process 500. In one example, the echo canceler is implemented in software and stored in a computer 104 memory. Additionally or alternatively, the vehicle 100 may include electronics, e.g., firmware such as described above, for implementing the echo canceler operation.

The process 500 begins in a block 510 in which the computer 104 receives audio data from an audio sensor 106. The computer 104 may be programmed to receive audio data via a vehicle 100 communication bus, e.g., CAN bus, from an active noise canceling sensor mounted to a vehicle 100 exterior, a noise sensor inside a vehicle 100 tire pressure sensor, etc.

Next, in a block 520, the computer 104 determines a present type of noise detected in the block 510. The computer 104 may be programmed to determine an urban road noise, suburban noise, lack of noise, etc., based on the received audio data. The computer 104 may store an identifier in the computer 104 memory based on the identified noise, e.g., 1 for road noise, 2 for suburban noise, 3 for low or negligible noise, etc.

Next, in a block 530, the computer 104 determines number of a number of taps for an echo canceler. For example, the computer 104 may determine a rating score improvement of 0.5 based on detected urban road noise and determine that 2 taps L can be removed.

Next, in a block 540, the computer 104 communicates with the echo canceler to reduce the number of taps L, e.g., actuating the echo canceler to remove 2 taps L. The echo canceler then recalculates the weights that correspond to the updated number of taps, e.g., L-2 taps (upon receiving an instruction to reduce 2 taps) in a way that the acoustic channel is modeled as accurately as possible.

Next, in a block 550, the computer 104 performs the echo canceler operation. The computer 104 inputs the updated number of taps L to an echo canceler program stored in the computer 104 memory. Thus, the computer 104 operates the echo canceler program based on the updated number of taps. The computer 104 may be programmed to receive audio data from one or more audio sensors 106 mounted to an exterior of the vehicle 100 and output the received audio data via the loudspeaker 102 while eliminating or reducing echo based on the updated number of taps L. As discussed above, the echo canceler may alternatively be implemented in an electronic circuit, e.g., a firmware. In such an example, the computer 104 may be programmed to output an instruction including an updated number of taps L, e.g., L-2, to the echo canceler firmware, etc., e.g., via a communication network such as CAN bus, etc.

Following the block 550, the process 500 ends, or returns to the block 510, although not shown in FIG. 5.

The disclosed technique advantageously reduces computer 104 resources utilized for echo cancelation by reducing the resources used for echo cancelation upon determining that noise from a surrounding environment, e.g., road noise, suburban noise, etc., increases the echo rating scale.

The invention claimed is:

1. A system for dynamically controlling an echo canceler, comprising a processor and a memory, the memory storing instructions executable by the processor to:

receive audio data from an audio sensor;

determine a present type of noise in the received audio data;

determine a score based on the present type of noise;

based on the score determined based on the present type of noise, and a determined adaptation curve for the present type of noise, determine a number of taps to be removed from a number of taps specified for the echo canceler; and execute the echo canceler with a reduced number of taps based on the number of taps to be removed.

2. The system of claim 1, wherein the present type of noise is selected from a plurality of types of noise, wherein the instructions further include instructions to determine the present type of noise based on data stored in the memory specifying respective noise characteristics of the types of noise.

3. The system of claim 1, further comprising the audio sensor mounted to an exterior of a vehicle and a speaker mounted in an interior of the vehicle, wherein the instructions further include instructions to actuate the echo canceler canceling an echo between the audio sensor and the speaker based on the determined number of taps to be reduced.

4. The system of claim 1, wherein the audio sensor includes one or more of a microphone, a tire pressure sensor, and a pressure sensor.

5. The system of claim 1, wherein the instructions further include instructions to:

periodically update the type of noise and dynamically update the number of taps of the echo canceler;

update the determined score based on the updated type of noise; and update the number of taps to be removed based on the updated score.

6. The system of claim 1, wherein the instructions further include instructions to receive audio data from the audio sensor mounted to an exterior of a vehicle and output the received audio data to a loudspeaker mounted to an interior of the vehicle while reducing an echo in the output audio data based on an operation of the echo canceler.

7. A method, comprising:

receiving audio data from an audio sensor;

determining a present type of noise in the received audio data;

determining a score based on the present type of noise;

based on the score determined based on the present type of noise, and a determined adaptation curve for the present type of noise, determining a number of taps to be removed from a number of taps specified for an echo canceler; and executing the echo canceler with a reduced number of taps based on the number of taps to be removed.

8. The method of claim 7, further comprising determining the present type of noise based on data stored in the memory specifying respective noise characteristics of respective types of noise, wherein the present type of noise is selected from the types of noise.

9. The method of claim 7, further comprising actuating the echo canceler canceling an echo between the audio sensor and the speaker based on the determined number of taps to be reduced, wherein the audio sensor is mounted to an exterior of a vehicle and a speaker is mounted in an interior of the vehicle.

10. The method of claim 7, wherein the audio sensor includes one or more of a microphone, a tire pressure sensor, and a pressure sensor.

11. The method of claim 7, further comprising:

periodically updating the type of noise and dynamically updating the number of taps of the echo canceler;

updating the determined score based on the updated type of noise; and updating the number of taps to be removed based on the updated score.

12. The method of claim 7, further comprising receiving audio data from the audio sensor mounted to an exterior of a vehicle and outputting the received audio data to a loudspeaker mounted to an interior of the vehicle while reducing an echo in the output audio data based on an operation of the echo canceler.

* * * * *